US005908051A

United States Patent [19]

Froment et al.

[11] Patent Number: 5,908,051

[45] Date of Patent: Jun. 1, 1999

[54] ACTUATING ELECTROMAGNETIC SELECTION DEVICE FOR DOBBY MECHANISMS

[75] Inventors: Jean-Paul Froment, Doussard; Jean-Pierre Pages, Faverges, both of France

[73] Assignee: Staubli Faverges, Faverges, France

[21] Appl. No.: 08/990,793

[22] Filed: Dec. 15, 1997

[30] Foreign Application Priority Data

Dec. 31, 1996 [FR] France ..... 96 16393

[51] Int. Cl.[6] ..... D03C 1/00

[52] U.S. Cl. ..... 139/66 R; 139/455; 335/276

[58] Field of Search ..... 139/68, 66 R, 139/76, 455; 335/276, 266

[56] References Cited

U.S. PATENT DOCUMENTS

| | | | |
|---|---|---|---|
| 2,527,220 | 10/1950 | Hughes | 335/243 |
| 3,956,722 | 5/1976 | Lagarde | 335/103 |
| 4,452,281 | 6/1984 | Speich . | |
| 4,461,325 | 7/1984 | Palau et al. . | |
| 4,803,506 | 2/1989 | Diehl et al. . | |
| 5,265,650 | 11/1993 | Vinciguerra | 139/337 |
| 5,365,979 | 11/1994 | Yoshida . | |

FOREIGN PATENT DOCUMENTS

| | | |
|---|---|---|
| 0068139 | 5/1982 | European Pat. Off. . |
| 0324423 | 1/1988 | European Pat. Off. . |
| 0606517 | 7/1994 | European Pat. Off. . |
| 2515703 | 11/1981 | France . |

*Primary Examiner*—Andy Falik
*Attorney, Agent, or Firm*—Dowell & Dowell, P.C.

[57] ABSTRACT

An actuating selection device for a dobby mechanism for controlling movement of components used to affect movement of a heddle frame and a weaving loom wherein the selection device includes selector members which are pivotally mounted adjacent pole faces of an electromagnet and wherein a moveable armature is pivotally connected to the selector member and includes an outer extremity which is continuously urged into contact with a first of the poles of the electromagnet by a resilient element. The selector member is spaced from the electromagnet when no power is applied thereto and the selector member is moved toward the other pole of the electromagnet together with the moveable armature when power is supplied to the poles of the electromagnet with the movement of the selective member thus controlling the movement of the pair of components which affect the movement of the heddle frame.

11 Claims, 4 Drawing Sheets

ACTUATING ELECTROMAGNETIC SELECTION DEVICE FOR DOBBY MECHANISMS

BACKGROUND OF THE INVENTION

1. Field of the Invention

The present invention relates to dobbies and other weaving mechanisms to form the shed on weaving looms and it relates more specifically to the actuating mechanisms of electromagnetic selection which, in conjunction with the reading-in devices, control the mechanisms of this type depending on the design of the fabric during the weaving process.

2. Description of the Related Art

The document FR-A-2 515 703 (STAUBLI) describes an actuating mechanism of such type, that comprises as many electromagnets as there are heald shafts of the mechanism, that is to say, of amplifying systems and of heddle frames in the loom. The electromagnets, fed by the reading-in device, depending on the weave program, are installed on one only chassis that is driven by an oscillating motion connected to that of the mechanism and that is provided, each heddle, with a pivoting selector linked to elastic means that cause to separate it from the poles of attraction of the electromagnet in question. Thus, each selector is driven by an alternate displacement that cyclicly draws it closer and separates it from the rods of the two actuating mechanisms that effectuate the control of the contemplated amplifier system; the selection between the two elements of each pair is made by the respective electromagnet, depending on whether or not it is fed by the reading-in device of the mechanism.

Experience has shown that at the very high operating speeds, required in the future for the looms and the thereto associated weave mechanisms, the moveable armature that is part of every selector will strongly strike against the stationary armature of the electromagnet. These repeated impacts cause a relatively quick wear and tear on the assembly of the mechanism and moreover, in addition to considerable noise, give rise to vibrations that interfere with the operation of the mechanism and cause weaving defects. The practical disadvantages subsist even when the central section of each moveable armature is installed on a pivot firmly affixed to the body of the selector.

SUMMARY OF THE INVENTION

The present invention has the specific aim to remedy the above-mentioned disadvantages of the heretofore known mechanisms, by designing each pivoting selector so as to provide it with a coefficient of amplitude of motion such that its selective displacement proceeds in a distinct and precise manner in spite of a very reduced air-gap value.

The present invention consists essentially in providing each pivoting selector with a moveable armature that is linked to the selector at its extremity turned towards its axis of rotation, and to provide this moveable armature with elastic controlling means that act upon the opposite extremity thereof with the aim of keeping the latter in permanent contact with the respective pole of the contemplated electromagnet's stationary armature, thus causing by reaction the return of the selector to the released position, the release of the portion opposite to this selector from the other pole of the stationary armature, thus creating the air-gap necessary for the functioning of the unit.

BRIEF DESCRIPTION OF THE DRAWINGS

The invention, its characteristics and the advantages it presents will be better understood though the attached illustration, given only by way of example, and wherein.

DESCRIPTION OF THE PREFERRED EMBODIMENTS

Figure 1:
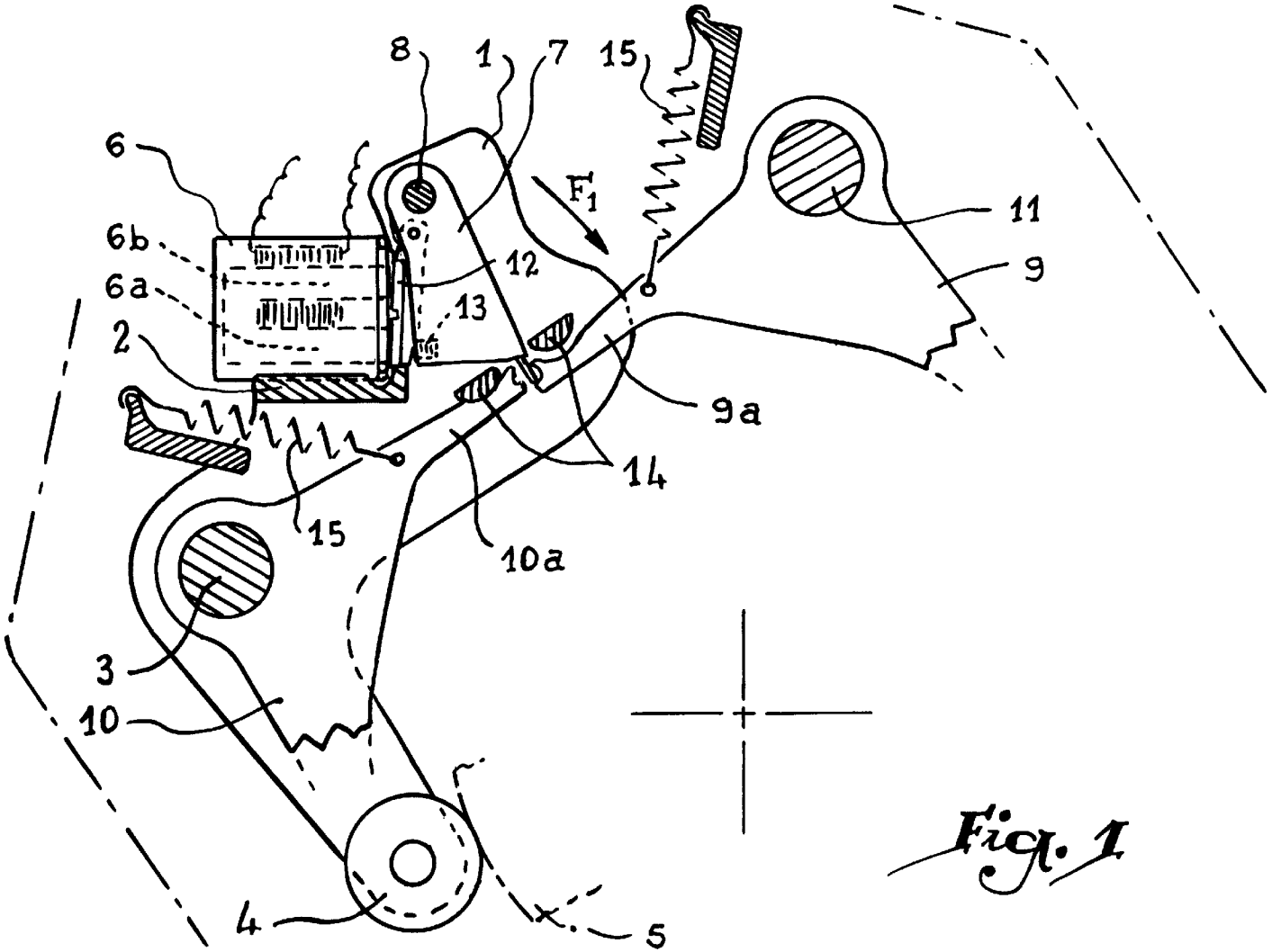
FIG. 1 is a cross section schematically showing the arrangement of an actuating mechanism in accordance with the invention at each of the heddles of a dobby of rotary type.

As in the case of the above-mentioned document, the actuating mechanism according to FIG. 1 is mounted on an oscillating chassis, formed by two lateral arms 1 linked by a longitudinal cross piece 2. Each of the arms 1, mounted on a stationary spindle 3, is provided with a roller 4 that is kept in contact with a revolving cam 5 by means of adequate elastic means; thus, the two cams of the system ensure the cyclic oscillation of the chassis 1–2 around the spindle 3, in the manner illustrated by the arrow $F_1$.

On the cross piece 2 of this oscillating chassis 1–2 is attached a block that comprises the assembly of the control electromagnets 6 fed by the reading-in device (not shown) of the contemplated mechanism. Opposite the stationary armature 6*a*–6*b* of each electromagnet 6 of the mentioned block is provided a pivoting selector 7 mounted on a stationary spindle 8 that links the two arms 1 parallel to the cross piece 2 of the chassis 1–2. The selectors 7 are mounted side by side on the spindle 8, having a minimum of play so that they are arranged opposite the poles of attraction of the different electromagnets 6.

Each selector 7 is intended to ensure the selective control of one or the other of the two oscillating components, lever or rods 9 and 10 that provide the actuating of a heddle of the mechanism. The assembly of the components 9 is affixed to a stationary spindle 11 while the axis of rotation of the components 10 is advantageously constituted by the axis of oscillation 3 of the chassis 1–2.

Figure 2:
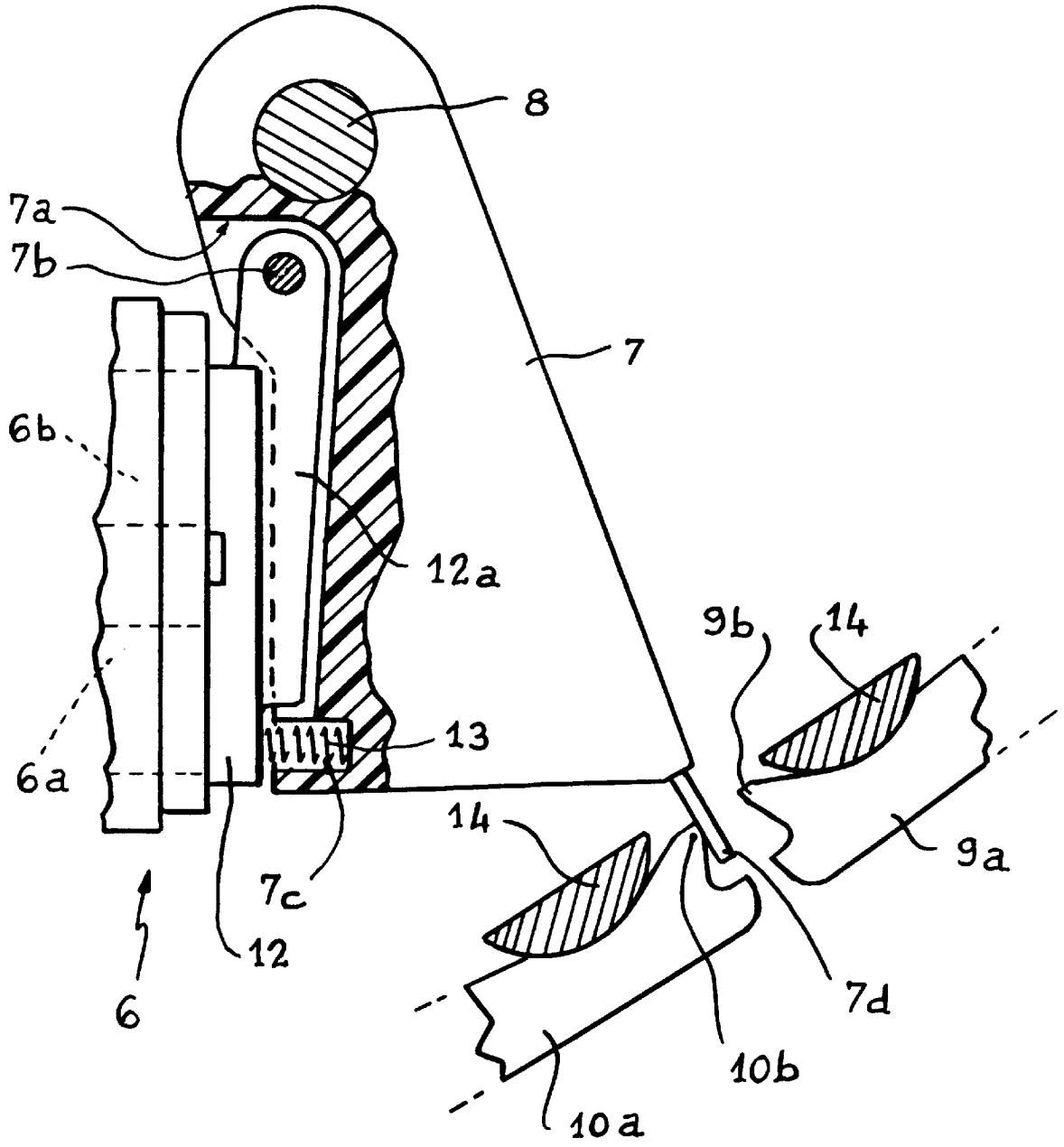
FIGS. 2 and 3 show in enlarged scale the selective operation of one of the pivoting selectors of the mechanism according to FIG. 1.

As shown in more details in FIG. 2, each selector 7 is provided at each of its edges turned towards the electromagnet 6, with a moveable armature 12, constituted by a strip of which the face is turned opposite to the armature 6*a*–6*b* of each electromagnet 6, integral with a thin strip 12*a* introduced in an opening 7*a* provided in the body of the selector, advantageously made out of a synthetic material. The extremity of the strip 12*a* that is adjacent to the axis of rotation 8 is linked inside of its opening 7*a* to a small pin 7*b,* while the extremity opposite to the armature 12 is subject to the permanent action of a spring 13 engaged in a recessed hole 7*c* of the selector body.

Figure 3:
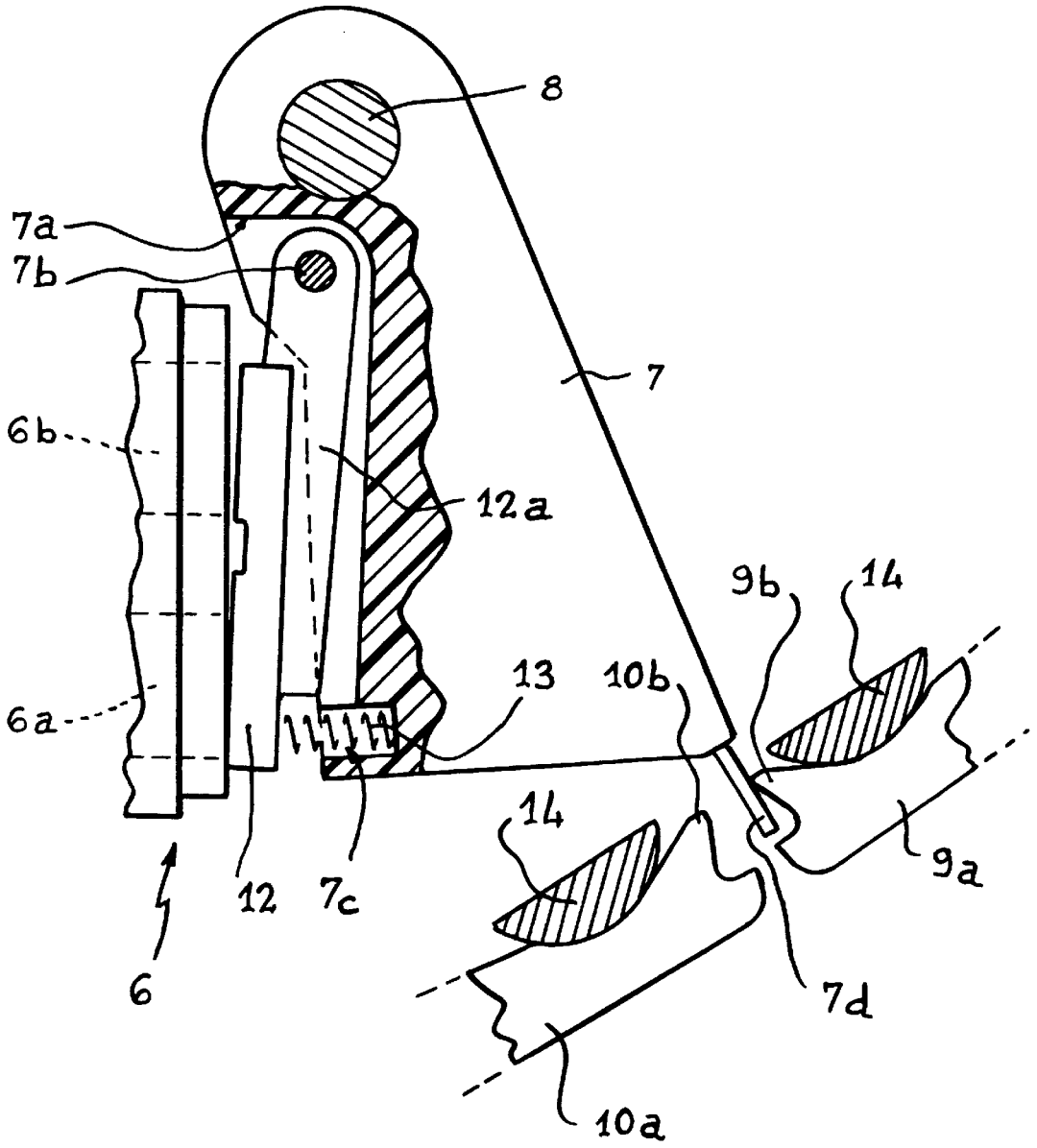

At the rest position illustrated in FIG. 3, that is to say, when the electromagnet 6 that corresponds to the contemplated selector 7 is not fed with electric current, the spring 13 resting against the back of armature 12 tends, on the one hand, to press the lower portion of this armature against the lower pole 6*a* of the stationary armature of electromagnet and, on other and simultaneously, to release the selector from it; the tilted direction thus imparted upon the armature creates a very slight air-gap at the level of the upper pole 6*b*.

In this position, the pin 7*d* that is provided on each selector 7 opposite the axis of rotation 8 is positioned facing the rod 9*a* of the component 9, in such a manner that, when in its oscillating motion the chassis 1–2 causes the lowering of the block of the electromagnets 6, said pin 7*d* comes to rest against the rod 9*a,* which is thus released from the stationary stop 14 against which it was pressed by a spring 15 (cf. FIG. 1).

Under these conditions, the component 9 is actuated to control the contemplated heddle of the mechanism. This control continues as long as the electromagnet in question is not fed by the reading-in device of the mechanism.

On the other hand, should the reading-in device causes current to be supplied to the magnetic flux generated by the stationary armature of the electromagnet causes the pull of the moveable armature 12. Given that the spring 13 always keeps the lower portion of the armature 12 pressed against the lower pole 6*a,* it is the upper portion of the armature that swings until its upper extremity presses against the upper pole 6*b;* this oscillating around the pin 6*b* causes the rotating of the selector 7, moving to the position illustrated in FIG. 2.

The pin 7*d* is then positioned opposite the rod 10*a* of the component 10 which is thus actuated during the oscillating motion of the chassis 1–2.

It must be noted that the air-gap shown in FIG. 3 is very reduced, so that the effect generated by the magnetic flux is rather considerable, which enables one to resort to electromagnets of reduced size and of low energy consumption. Although this air-gap is reduced, the specific geometry of the device creates an amplifying effect and allows a big displacement at the level of the pin 7*d.*

Evidently, since the contemplated electromagnet 6 is no longer fed by the reading-in device, the spring 13 automatically causes the selector 7 to pass from the position shown in FIG. 2 to the one illustrated in FIG. 3.

It can be noted that the amplitude of the angular displacement of selector 7 is limited by the reach of the pin 7*d* against one or the other of the two stops 9*b* or 10*b,* respectively, provided for this purpose at the end of the rods 9*a,* 10*a* of the components 9, 10.

Each selector 7 is advantageously fabricated by injection and molding out of a magnetic material, inside of which is directly embedded the extremity of pin 7*d,* made out of steel.

The assembly 7–12 is very compact. Its useful life is very long and the functioning of the electromagnet is very efficient, while the unavoidable imprecisions of the system are absorbed by the fact that the moveable armature is always resting against the stationary armature 6*a*–6*b* by at least one of its extremities.

Furthermore, it must be understood that the above description is given only by way of example and that it does not limit at all the scope of the invention, from which one would not deviate by replacing the described design details with equivalent ones.

Figure 4:
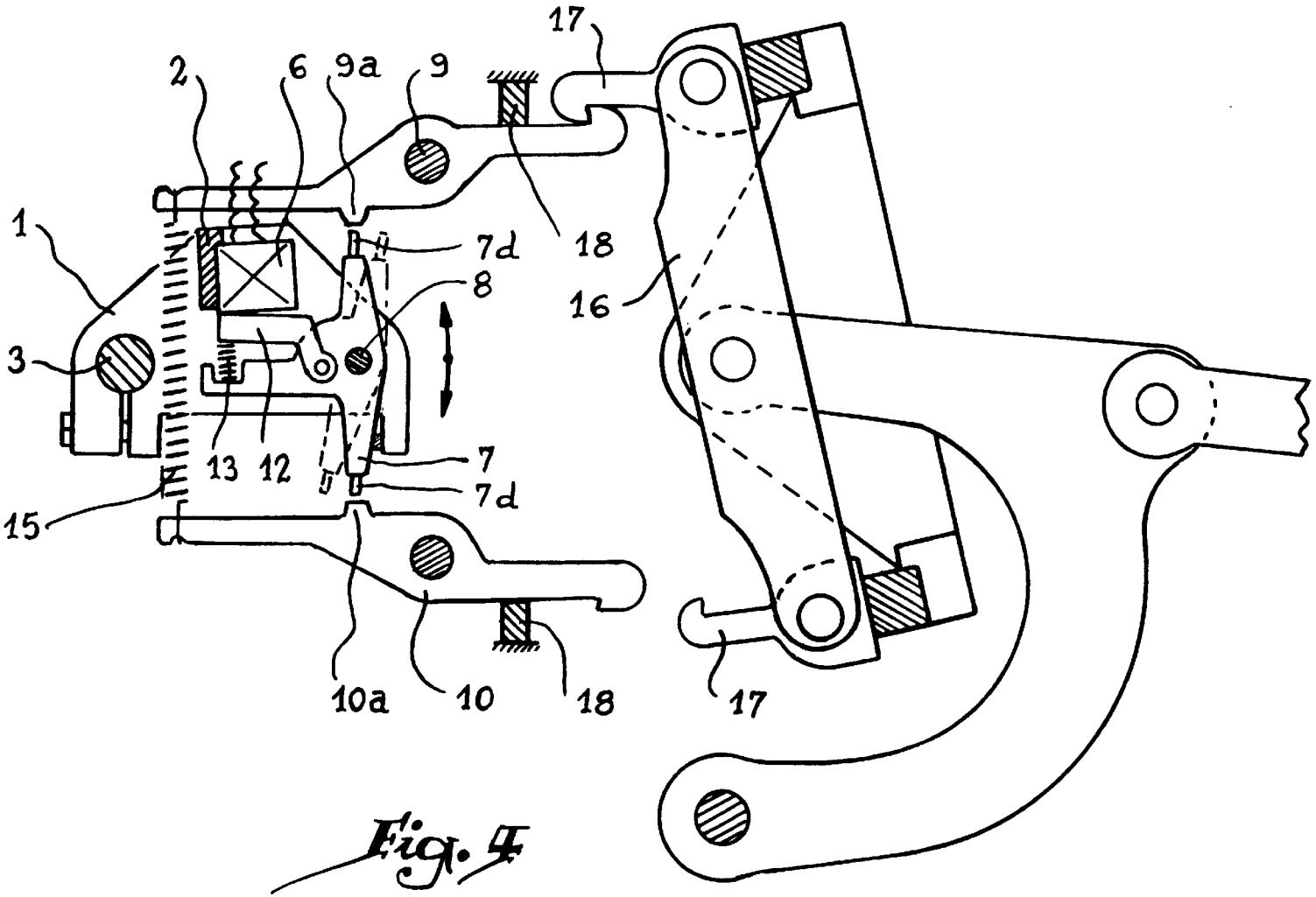
FIG. 4 shows a variant of the implementation of the invention.

It can be noted in particular that the present invention can be advantageously applied to balance dobbies of such type, as schematically illustrated in FIG. 4. Each balance 16 is provided at its extremities with two pivoting attachment hooks 17 that are intended to interact with the control components 9 and 10, herein in the form of swivel-mounted hooks while a spring 15 tends to keep them elastically applied against stationary stops 18. There is an oscillating chassis 1–2 that constitutes the support for a block of electromagnets 6, each of which controls only one selector 7 provided with a moveable armature 12 identical to the one according to the embodiment of FIG. 1.

Each selector 7 is provided with two pins 7*d* positioned in opposite directions in order to provide the actuating of the components or hooks 9–10 by coming, during the oscillating displacement of the chassis 1–2, into contact with the surfaces 9*a,* 10*a* of the hooks. On the other hand, when the contemplated electromagnet 6 is fed, the moveable armature 12 is pulled toward the stationary armature in such a manner that the selector 7 rotates around its spindle 8 and reaches the oblique position shown in broken lines; the oscillation of the chassis 1–2 continues but the pins 7*d* cannot come into contact with the surfaces 9*a* and 10*a* although the components or hooks 9 and 10 are not driven.

What we claim is:

1. An actuating selection device for a dobby mechanism for controlling movement of a pair of components which are used to effect movement of a heddle frame of a weaving loom dependent upon activation of an electromagnet having spaced first and second poles by a reading-in device, the actuating selection device comprising: a selector member, means for pivotally mounting said selector member relative to the electromagnet, a moveable armature pivotally connected at a pivot point to said selector member and having a face portion opposing the first and second poles of the electromagnet and an outer extremity spaced from said pivot point, means for continuously resiliently urging said outer extremity of said moveable armature into contact with the first pole of the electromagnet so that whenever the second pole of the electromagnet is not activated, said face portion of said moveable armature spaced from said outer extremity is in a first position spaced from the second pole of the electromagnet and such that said face portion of said moveable armature spaced from said outer extremity is urged to a second position toward the second pole of the electromagnet when the second pole is activated thereby moving said selector member relative to the pair of components for effecting movement of the heddle frame, and said selector member having at least one portion for selectively engaging at least one of the pair of components depending upon whether said face portion of said moveable armature spaced from said outer extremity is in said first or said second position.

2. The actuating selection device of claim 1 wherein said selector member includes a body, said moveable armature including a strip at least partially housed within an opening in said body, and said strip having an extremity opposite said outer extremity which is pivotally attached at said pivot point to said body.

3. The actuating selection device of claim 2 in which said means for continuously resiliently urging said outer extremity of said moveable armature into contact with the first pole of the electromagnet includes a spring element carried by said selector member.

4. The actuating selection device of claim 1 in which said means for continuously resiliently urging said outer extremity of said moveable armature into contact with the first pole of the electromagnet includes a spring element carried by said selector member.

5. The actuating selection device of claim 1 wherein said selector member is molded of a magnetic material.

6. The actuating selection device of claim 5 in which said at least one portion of said selector member is a metal pin embedded within and extending outwardly of the molded magnetic material of said selector member.

7. The actuating selection device of claim 6 in which said selector member includes two generally oppositely oriented portions for selectively engaging opposite ones of the pairs of components, and said two portions, each being formed by a metallic pin embedded within said metallic material and extending outwardly relative thereto.

8. The actuating selection device of claim 7 in which the pair of components are formed as spaced pivoting hooks adapted to interact with attachment hooks associated with a balance mechanism of a dobby of the weaving loom.

9. The actuating selection device of claim 1 in which said means for pivotally mounting said selector member includes a chassis element adapted to be moved in an oscillating manner and to which is mounted the electromagnet, and a pivot element extending from said chassis element for pivotally supporting said selector member relative thereto.

10. The actuating selection device of claim 9 wherein said chassis member is pivoted about a pivot member, and one of the pair of components being pivoted about said pivot member.

11. The actuating selection device of claim 1 wherein each of the pair of components includes a stop element adapted for limiting an angular displacement of said selector member.

* * * * *